US006578848B1

(12) United States Patent
Champion et al.

(10) Patent No.: US 6,578,848 B1
(45) Date of Patent: Jun. 17, 2003

(54) GAME WITH MOVEABLE PLAY SPACE

(75) Inventors: Mario M. Champion, Austin, TX (US); Mark Christopher Zatopek, Austin, TX (US); Frank Matthew Champion, Austin, TX (US)

(73) Assignee: Team Smartypants!, Inc., Austin, TX (US)

( * ) Notice: Subject to any disclaimer, the term of this patent is extended or adjusted under 35 U.S.C. 154(b) by 4 days.

(21) Appl. No.: 09/721,308

(22) Filed: Nov. 22, 2000

(51) Int. Cl.[7] ..... A63F 1/00

(52) U.S. Cl. ..... 273/292; 273/134; 273/236; 273/242; 273/243; 273/249; 273/260; 273/261; 273/258; 273/282; 273/284; 273/281; 273/283

(58) Field of Search ..... 273/292, 134, 273/242, 289, 241, 243, 260, 261, 249, 284, 282, 236, 258, 262, 281, 283

(56) References Cited

U.S. PATENT DOCUMENTS

| | | | | | |
|---|---|---|---|---|---|
| 107,065 | A | * | 9/1870 | Krath | |
| 300,534 | A | * | 6/1884 | Bibber | 273/153 |
| 1,978,107 | A | * | 10/1934 | Hoffman | 273/153 |
| 3,630,526 | A | * | 12/1971 | Winkless, III | 273/136 A |
| 3,817,530 | A | * | 6/1974 | Howard | 273/135 R |
| 3,820,791 | A | * | 6/1974 | Powers | 273/131 B |
| 3,831,944 | A | * | 8/1974 | Upton | 273/131 BB |
| 3,860,241 | A | * | 1/1975 | Leftin | 273/134 AE |
| 3,973,775 | A | * | 8/1976 | Bolan et al. | 273/134 AA |
| 3,989,253 | A | * | 11/1976 | Schifman | 273/131 B |
| 4,036,500 | A | * | 7/1977 | Kiernan | 273/130 AB |
| 4,147,362 | A | * | 4/1979 | Fisher | 273/282 |
| 4,232,864 | A | * | 11/1980 | Yaworsky | 273/241 |
| 4,378,118 | A | * | 3/1983 | Leonardi, Jr. | 273/292 |
| 4,544,162 | A | * | 10/1985 | Ferris et al. | 273/242 |
| 4,647,049 | A | * | 3/1987 | Oretsky et al. | 273/264 |
| 4,850,597 | A | * | 7/1989 | Milliken | 273/254 |
| 4,973,254 | A | * | 11/1990 | Bracconier | 434/324 |
| 5,678,819 | A | * | 10/1997 | Underwood | 273/241 |
| 5,971,395 | A | * | 10/1999 | Swift | 273/262 |
| 6,149,156 | A | * | 11/2000 | Feola | 273/292 |

* cited by examiner

*Primary Examiner*—Benjamin H. Layno
*Assistant Examiner*—D Collins
(74) *Attorney, Agent, or Firm*—Gregory K. Goshorn; Greg Goshorn, P.C.

(57) ABSTRACT

A game with moveable play space. The invention allows any user playing the game to modify the play space at any number of given times and in response to any number of different conditions. Certain spaces (tiles or blocks) within the play space are wildcard spaces that independently initiates modification of the game play space. Any game play space can benefit from the invention, including conventional game boards including chess and checker boards. The modifications of the game play space include any number of manipulations including column shuffling, rotating, flip-flopping, and other types of manipulation. The selection of which portion of the game play space is made by the players of the game. If desired, the selection of which portion of the game play space is governed by the space on which a game piece resides, or the particular type of game piece that is being moved or used in that game. Some games have different types of players; in some embodiments of the inventions, these types of players govern how modification to the game play space is made. In volumetric games, certain volumetric portions are able to be exchanged with one another during the modification of the game play space. Modification of the game play space is performed along various surfaces within the volumetric game play space, or within certain individual game sub-volumes that together integrate to form the entire volumetric game play space. In addition, the invention is operable within any number of variations of a GridBloc game.

20 Claims, 16 Drawing Sheets

Square or Non-Square Cross-sections
Varying Degrees/Types of Movements

Standard 8x8 Checker/Chess Board

- Single or Multiple Players
- Various Types of Moves/Rotates

- Two Players
- Each Player With Single Move/Rotate

GAME WITH MOVEABLE PLAY SPACE

CROSS REFERENCE TO RELATED APPLICATIONS

The following U.S. Patent Application is hereby incorporated herein by reference in its entirety and made part of the present U.S. Patent Application for all purposes:

1) U.S. patent application Ser. No. 09/696,327, entitled "GRIDBLOC STRATEGY GAME," filed Oct. 25, 2000.

BACKGROUND

1. Technical Field

The present invention relates generally to games; and, more particularly, it relates to a game having at least a portion of the game space being moveable.

2. Related Art

There is no game known to the inventors having moveable and/or rotatable game space portions related to a game that is played in accordance with the present invention. Further limitations and disadvantages of conventional and traditional game systems will become apparent to one of skill in the art through comparison of such systems with the present invention as set forth in the remainder of the present application with reference to the drawings.

SUMMARY OF THE INVENTION

Various aspects of the present invention can be found in a game board having a portion of a game play space that is movement-capable. The game board includes a game play space having spaces of a first arrangement, and a selected portion of the game play space that is operable to be modified. Upon the modification, the game play space is changed from the first arrangement to a second arrangement.

In certain embodiments of the invention, the portion of the game play space that is movement-capable includes a game board having uniform blocks arranged in an 8×8 block configuration. The selected portion of the game play space includes a number of spaces that are arranged contiguously, and the selected portion of the game play space is modified. The modification of the selected portion of the game play space is initiated by any number of things or events including at least one of a player, a type of game piece used by the player, a type of the game, or a location of the player in the game play space. Each of any number of players is able to modify the selected portion of the game play space from the first arrangement to the second arrangement at least once during the course of a game. The spaces include spaces of at least two types of shapes that are inter-mingled. The game play space is at least one of a two-dimensional game play space and a three-dimensional game play space. The selected portion of the game play space that is operable to be modified includes spaces along a surface of a three-dimensional game play space. The selected portion of the game play space that is operable to be modified includes at least two volumes within a three-dimensional game play space.

Other aspects of the present invention can be found in a game having a moveable play space. The game includes a game play space having a number of spaces, and at least two of the spaces are capable to be interchanged.

In certain embodiments of the invention, the game includes a GridBloc game. A selected portion of the game play space is rotated a predetermined number of degrees.

The at least two of the number of spaces are capable to be interchanged, and the interchanging is initiated by any number of things or events including at least one of a player of the game and a type of game piece used by the player of the game. The game play space is a three-dimensional game play space in one embodiment, and the game play space is a two-dimensional game play space in other embodiments. The modification of a selected portion of the game play space is any number of modifications including column shifting and flip-flopping.

Other aspects of the present invention can be found in a method to modify a game play space of a game. The method includes selecting a portion of a game play space, and modifying the selected portion of the game play space.

In certain embodiments of the invention, the game includes a GridBloc game. The modifying the selected portion of the game play space is initiated by any number of things or events including a player of the game and a type of game piece used by the player of the game. In one embodiment, the game play space is a two-dimensional game play space; in others, the game play space is a three-dimensional game play space. The selected portion of the game play space includes at least two volumes within a three-dimensional game play space.

Other aspects, advantages and novel features of the present invention will become apparent from the following detailed description of the invention when considered in conjunction with the accompanying drawings.

BRIEF DESCRIPTION OF THE DRAWINGS

A better understanding of the present invention can be obtained when the following detailed description of various exemplary embodiments are considered in conjunction with the following drawings.

DETAILED DESCRIPTION OF THE INVENTION

Various number and types of games are able to benefit from the present invention. Any one-dimensional, two-dimensional or volumetric game play space is able to use the present invention. The operations performed by the present invention allow for a much greater complexity of any given game by offering, virtually, innumerable variations of the game using the present invention. From certain perspectives, the ability to modify the play space of a game allows for a renewing and refreshing of many traditional games. The ability to modify the game to generate seemingly new games from traditionally available games greatly enhances the competitiveness and strategy required to play such games. The number of times that the various players can employ modifying the game space can be governed by the players, or alternatively by a set of rules applied to each game. A number of games are performed in succession where the winner is determined as having won the majority of the games of the total number of games played. If desired, the abilities of the players to modify the game play space is modified from game to game. For example, in one situation, one of the players has an advantage to modify the game play space when compared to the other player (in a two-player game) or to all of other players (in a multi-player game). Alternatively, the abilities of the players to modify the game play space are the same for each and every game.

As briefly mentioned, the present invention is operable within any number of different types of games. Certain portions of a two-dimensional game board are selected and the tiles, or blocks of that selected portion, are manipulated to modify the game play space by one of the players of the game. Alternatively, certain spaces, tiles, or blocks are predetermined as being wildcard or active spaces, tiles, or blocks, and when one of those spaces, tiles, or blocks is occupied, a portion of the game play space is automatically modified. This option is equally operable in any game play space as well. Other variations will become more apparent by the representative examples shown below in the various Figures.

Figure 1B:
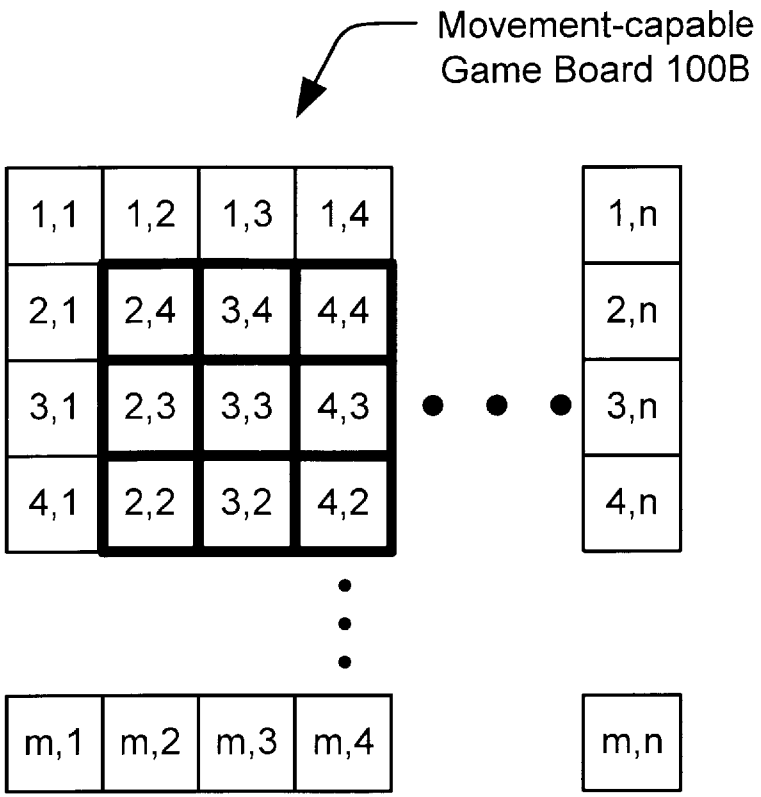
FIG. 1B is a perspective diagram illustrating the movement-capable game board of the FIG. 1A after the movement operation shown in the FIG. 1A.
Figure 1A:
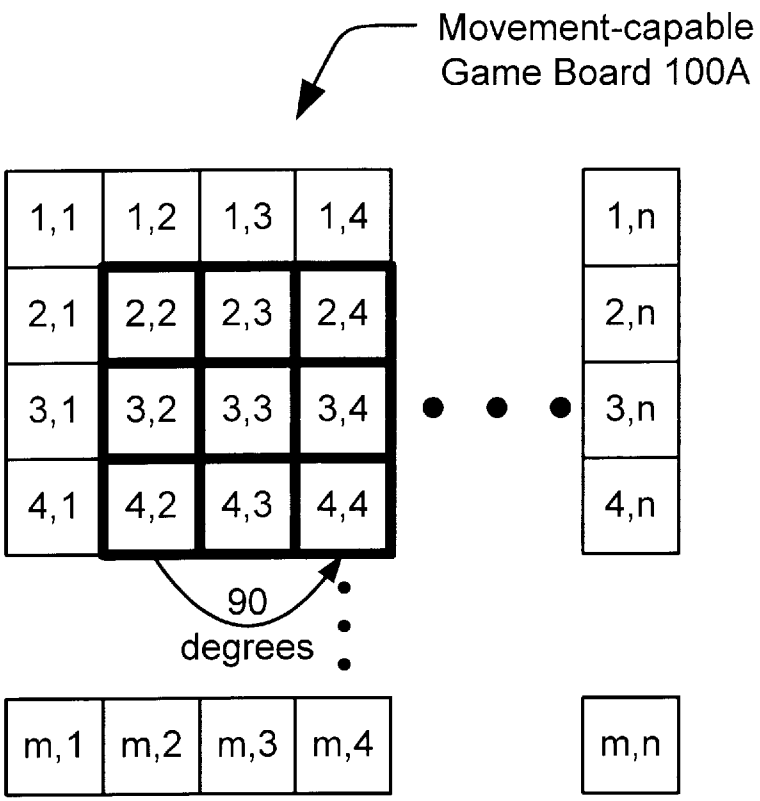
FIG. 1A is a perspective diagram illustrating an embodiment of a movement-capable game board built in accordance with the present invention.

FIG. 1A is a perspective diagram illustrating an embodiment of a movement-capable game board 100A built in accordance with the present invention. The movement-capable game board 100A is a two-dimensional game board having an indefinite dimension m,n. The spaces, blocks, or tiles of the movement-capable game board 100A have a first arrangement that is capable to be modified into a second arrangement. Within this discussion, the use of spaces, blocks, or tiles is used. It is understood that the appropriate application of a space, block, or tile, is with respect to the game play space being of one, two, three, or other multiple dimensions. A generic nomenclature for any of the types of blocks, tiles, or other types of portions of a game play space is spaces. A 3×3 portion of the game board 100A is shown having the spaces, tiles, or blocks of 2,2; 2,3; 2,4; 3,2; 3,3; 3,4; 4,2; 4,3; and 4,4. The portion of the game board 100A described above is contiguous in this particular embodiment, but the portion need not be in other embodiments. The entire 3×3 portion is rotated 90 degrees counter-clockwise (ccw) as shown by the arrow in the FIG. 1A. As mentioned above, the action that initiates the 90 degree rotation is any number of operations including initiation by any of the players of the game, by one of the players occupying a wildcard tile or block of the movement-capable game board 100A.

FIG. 1B is a perspective diagram illustrating the movement-capable game board 100B of the FIG. 1A after the movement operation shown in the FIG. 1A. After performing the 90 degree rotation in the FIG. 1A, the spaces, tiles, or blocks of 2,2; 2,3; 2,4; 3,2; 3,3; 3,4; 4,2; 4,3; and 4,4 of the FIG. 1A are moved, so that the same cross section, when viewed from left to right and top to bottom, is now shown as being the spaces, tiles, or blocks of 2,4; 3,4; 4,4; 2,3; 3,3; 4,3; 2,2; 3,2; and 4,2.

Figure 2B:
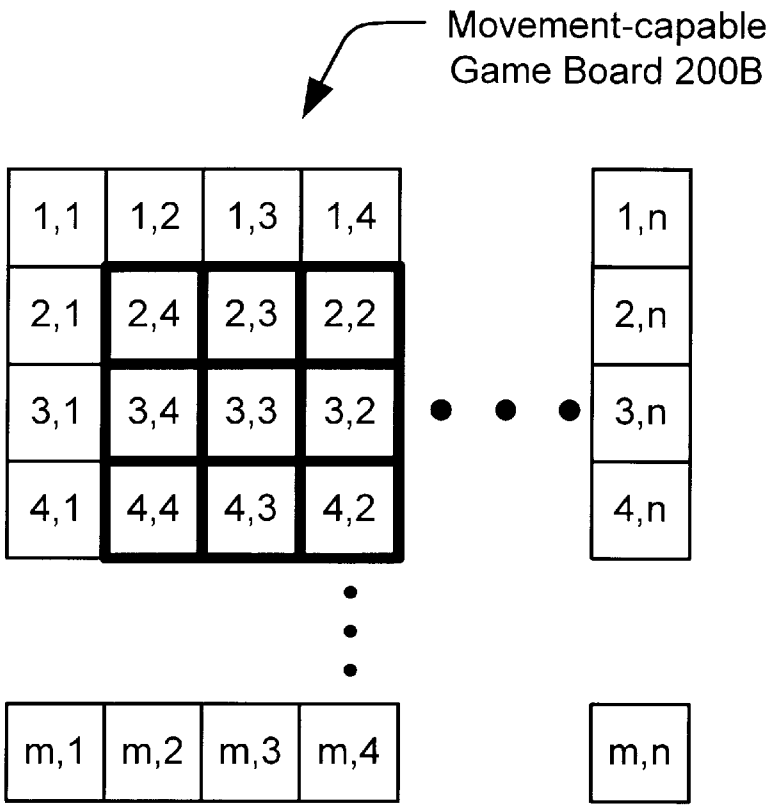
FIG. 2B is a perspective diagram illustrating the movement-capable game board of the FIG. 2A after the movement operation shown in the FIG. 2A.
Figure 2A:
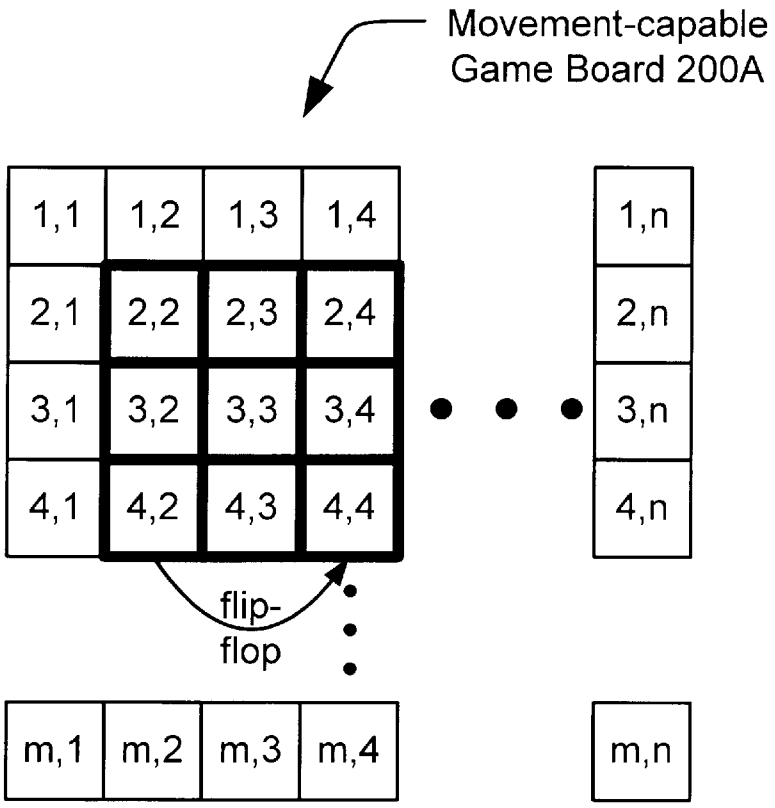
FIG. 2A is a perspective diagram illustrating another embodiment of a movement-capable game board built in accordance with the present invention.

FIG. 2A is a perspective diagram illustrating another embodiment of a movement-capable game board built 200A in accordance with the present invention. The movement-capable game board 200A is a two-dimensional game board having an indefinite dimension m,n. A 3×3 portion of the game board 200A is shown having the spaces, tiles, or blocks of 2,2; 2,3; 2,4; 3,2; 3,3; 3,4; 4,2; 4,3; and 4,4. Two of the columns of the selected 3×3 portion are flip-flopped as shown by the arrow in the FIG. 2A. Again, as mentioned above, the action that initiates the flip-flop movement is any number of operations including initiation by any of the players of the game, by one of the players occupying a wildcard tile or block of the movement-capable game board 200A.

FIG. 2B is a perspective diagram illustrating the movement-capable game board 200B of the FIG. 2A after the movement operation shown in the FIG. 2A. After performing the flip-flop movement in the FIG. 2A, the spaces, tiles, or blocks of 2,2; 2,3; 2,4; 3,2; 3,3; 3,4; 4,2; 4,3; and 4,4 of the FIG. 2A are moved, so that the same cross section, when viewed from left to right and top to bottom, is now shown as being the spaces, tiles, or blocks of 2,4; 2,3; 2,2; 3,4; 3,3; 3,2; 4,4; 4,3; and 4,2.

Figure 2D:
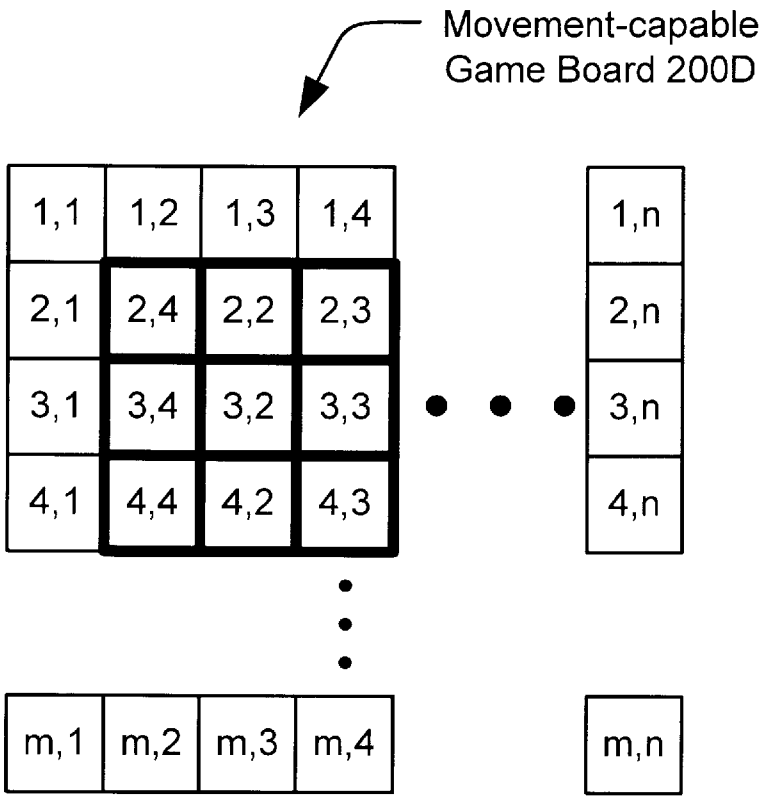
FIG. 2D is a perspective diagram illustrating the movement-capable game board of the FIG. 2C after the movement operation shown in the FIG. 2C.
Figure 2C:
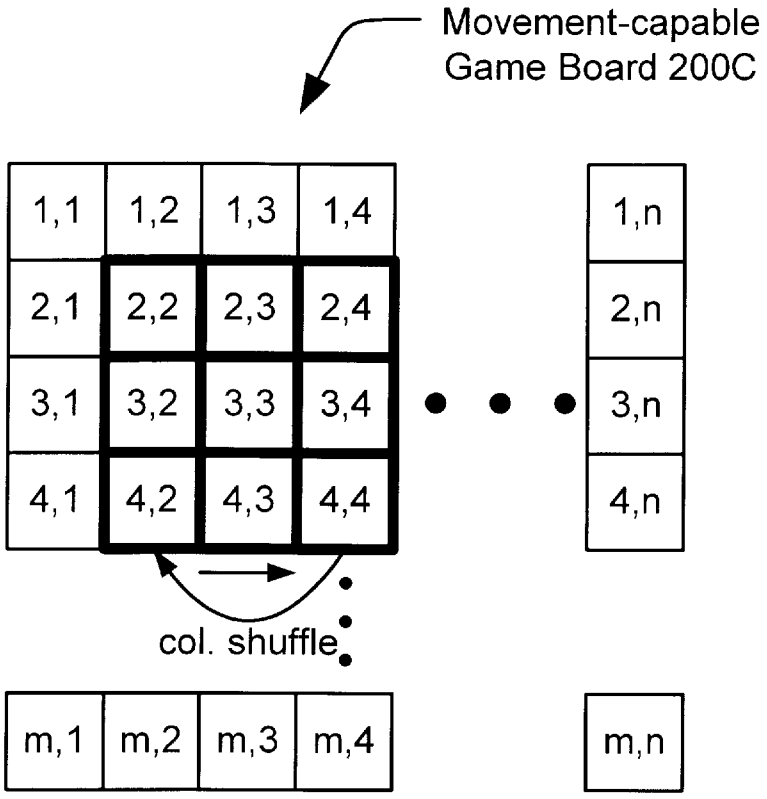
FIG. 2C is a perspective diagram illustrating another embodiment of a movement-capable game board built in accordance with the present invention.

FIG. 2C is a perspective diagram illustrating another embodiment of a movement-capable game board 200C built in accordance with the present invention. The movement-capable game board 200C is a two-dimensional game board having an indefinite dimension m,n. A 3×3 portion of the game board 200C is shown having the spaces, tiles, or blocks of 2,2; 2,3; 2,4; 3,2; 3,3; 3,4; 4,2; 4,3; and 4,4. The columns of the selected 3×3 portion are column shuffled to the right as shown by the arrow in the FIG. 2C. Again, as mentioned above, the action that initiates the column shuffle movement is any number of operations including initiation by any of the players of the game, by one of the players occupying a wildcard tile or block of the movement-capable game board 200C.

FIG. 2D is a perspective diagram illustrating the movement-capable game board 200D of the FIG. 2C after the movement operation shown in the FIG. 2C. After performing the column shuffle movement in the FIG. 2C, the spaces, tiles, or blocks of 2,2; 2,3; 2,4; 3,2; 3,3; 3,4; 4,2; 4,3; and 4,4 of the FIG. 2C are moved, so that the same cross section, when viewed from left to right and top to bottom, is now shown as being the spaces, tiles, or blocks of 2,4; 2,2; 2,3; 3,4; 3,2; 3,3; 4,4; 4,2; and 4,3.

Figure 2F:
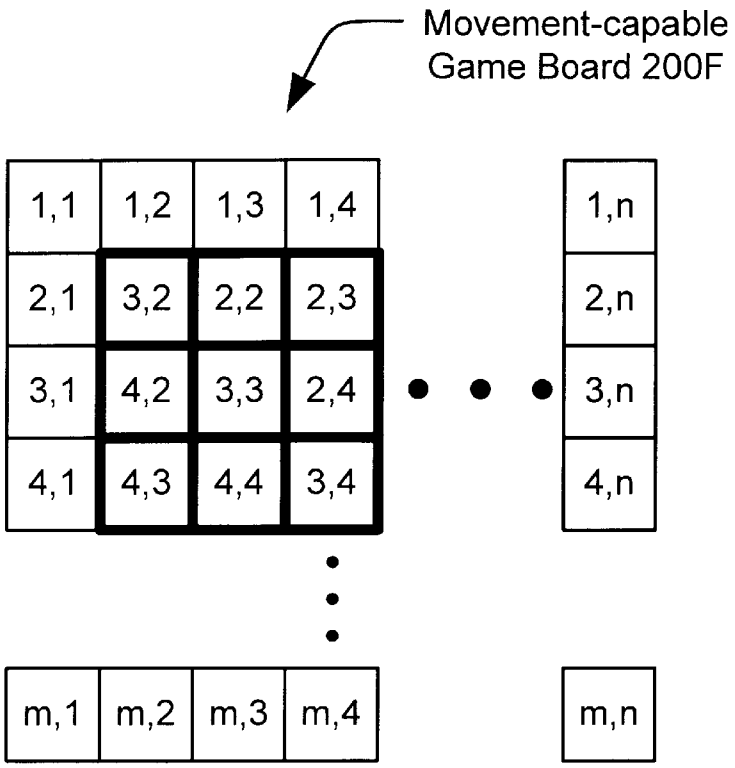
FIG. 2F is a perspective diagram illustrating the movement-capable game board of the FIG. 2E after the movement operation shown in the FIG. 2E.
Figure 2E:
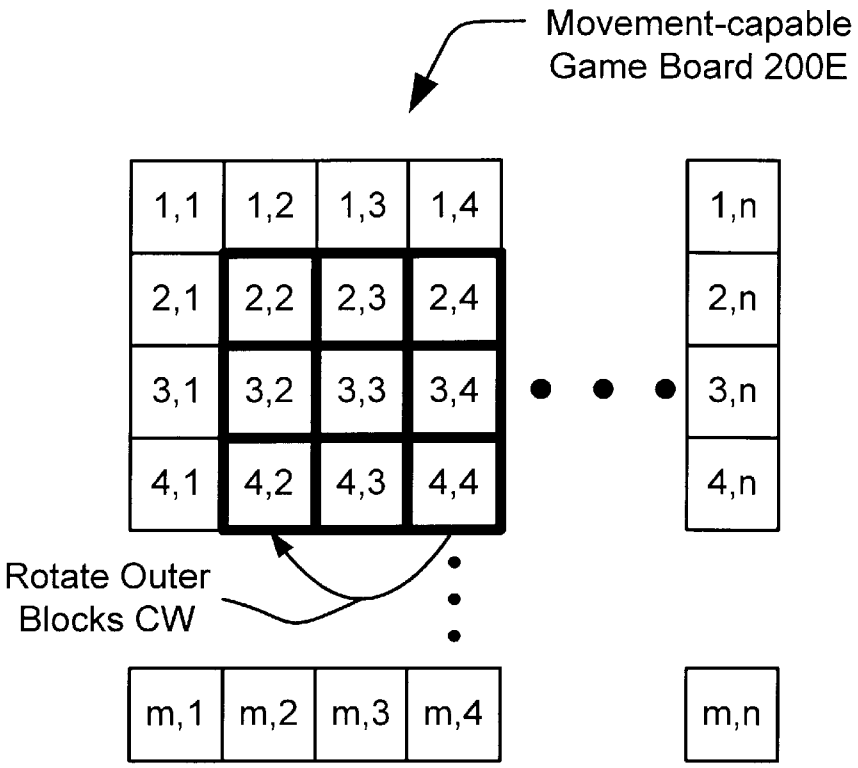
FIG. 2E is a perspective diagram illustrating another embodiment of a movement-capable game board built in accordance with the present invention.

FIG. 2E is a perspective diagram illustrating another embodiment of a movement-capable game board 200E built in accordance with the present invention. The movement-capable game board 200E is a two-dimensional game board having an indefinite dimension m,n. A 3×3 portion of the game board 200E is shown having the spaces, tiles, or blocks of 2,2; 2,3; 2,4; 3,2; 3,3; 3,4; 4,2; 4,3; and 4,4. The outer spaces, tiles, or blocks of the selected 3×3 portion are rotated clockwise (cw) one block as shown by the arrow in the FIG. 2E. Again, as mentioned above, the action that initiates the rotation movement is any number of operations including initiation by any of the players of the game, by one of the players occupying a wildcard tile or block of the movement-capable game board 200E.

FIG. 2F is a perspective diagram illustrating the movement-capable game board 200F of the FIG. 2E after the movement operation shown in the FIG. 2E. After performing the rotation movement in the FIG. 2E, the spaces, tiles, or blocks of 2,2; 2,3; 2,4; 3,2; 3,3; 3,4; 4,2; 4,3; and 4,4 of the FIG. 2F are moved, so that the same cross section, when viewed from left to right and top to bottom, is now shown as being the spaces, tiles, or blocks of 3,2; 2,2; 2,3; 4,2; 3,3; 2,4; 4,3; 4,4; and 3,4.

Figure 2H:
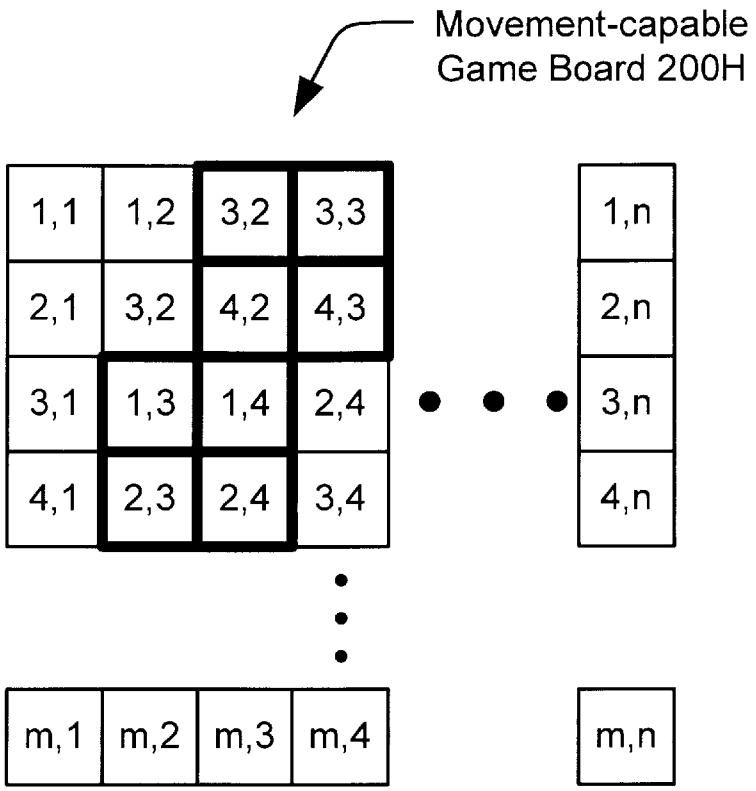
FIG. 2H is a perspective diagram illustrating the movement-capable game board of the FIG. 2G after the movement operation shown in the FIG. 2G.
Figure 2G:
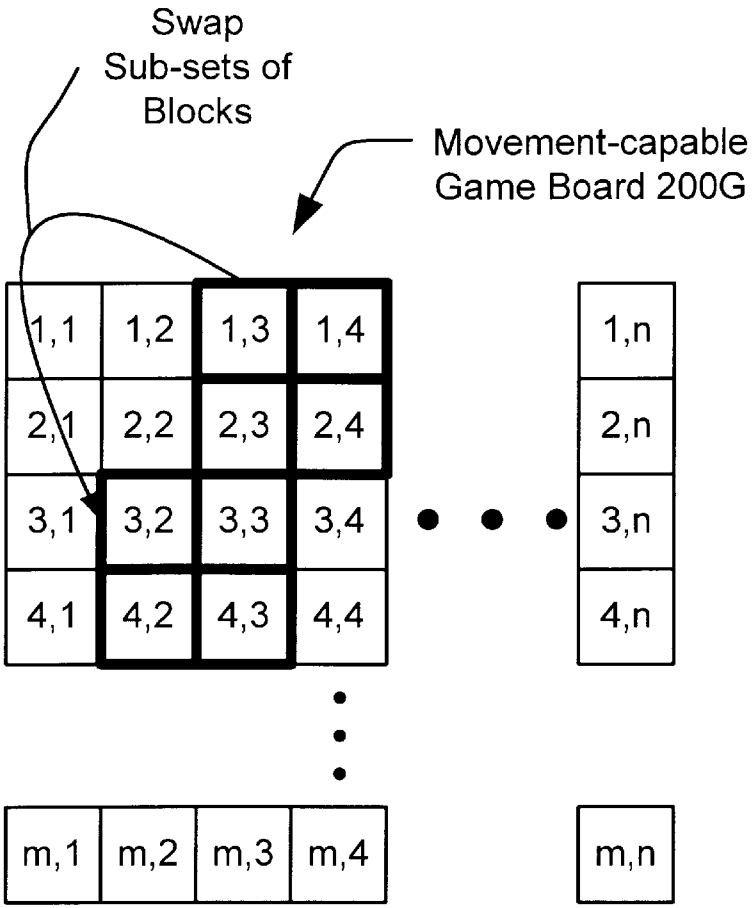
FIG. 2G is a perspective diagram illustrating another embodiment of a movement-capable game board built in accordance with the present invention.

FIG. 2G is a perspective diagram illustrating another embodiment of a movement-capable game board 200G built in accordance with the present invention. The movement-capable game board 200G is a two-dimensional game board having an indefinite dimension m,n. A selected portion of the game board 200G is shown having two 2×2 sub-sets: one sub-set of spaces, tiles, or blocks of 1,3; 1,4; 2,3; and 2,4 and one sub-set of spaces, tiles, or blocks of 3,2; 3,3; 4,2; and 4,3. The two sub-sets are swapped as shown by the arrow in the FIG. 2G. Similarly, as mentioned above, the action that initiates the swapping movement is any number of operations including initiation by any of the players of the game, by one of the players occupying a wildcard tile or block of the movement-capable game board 200G.

FIG. 2H is a perspective diagram illustrating the movement-capable game board 200H of the FIG. 2G after the movement operation shown in the FIG. 2G. After performing the swapping movement in the FIG. 2G, the sub-set of spaces, tiles, or blocks of 1,3; 1,4; 2,3; and 2,4 and the sub-set of spaces, tiles, or blocks of 3,2; 3,3; 4,2; and 4,3 of the FIG. 2G are moved, so that the same cross section, when viewed from left to right and top to bottom, is now shown as having the swapped sub-sets of the sub-set of spaces, tiles, or blocks of 3,2; 3,3; 4,2; and 4,3 and the sub-set of spaces, tiles, or blocks of 1,3; 1,4; 2,3; and 2,4.

Figure 2J:
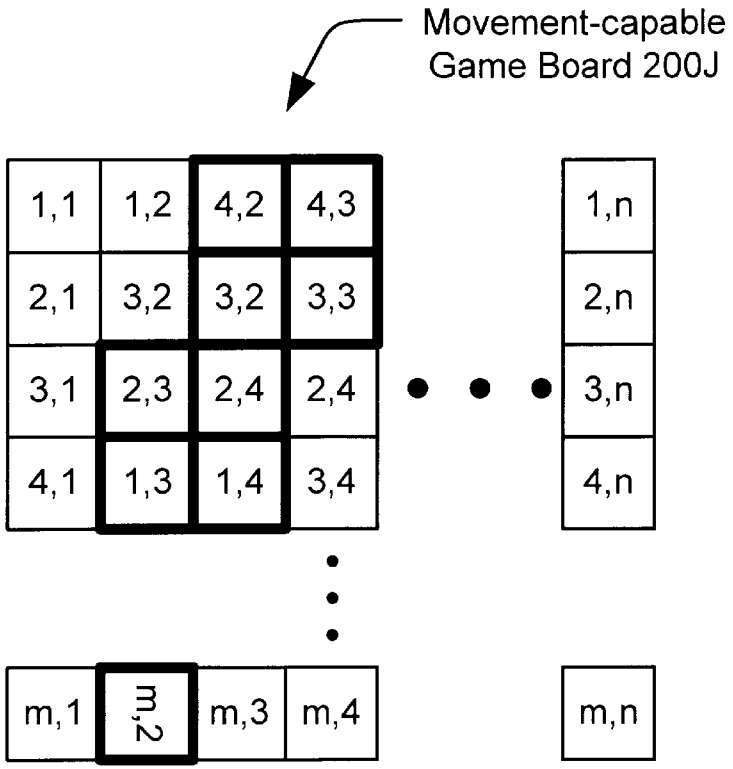
FIG. 2J is a perspective diagram illustrating the movement-capable game board of the FIG. 2I after the movement operation shown in the FIG. 2I.
Figure 2I:
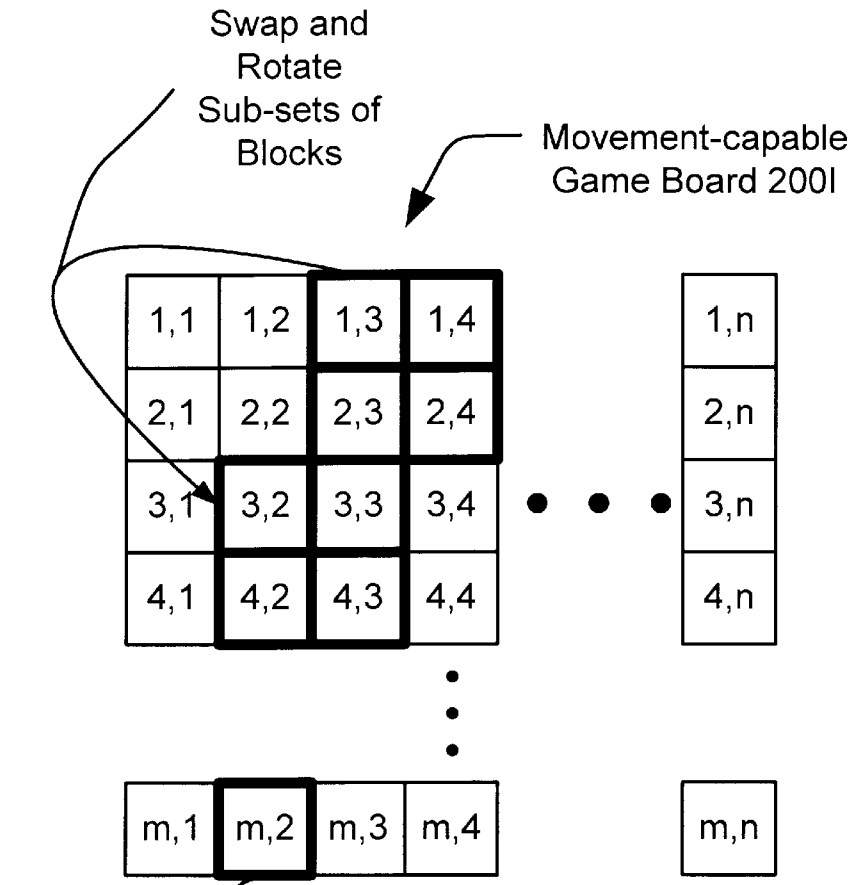
FIG. 2I is a perspective diagram illustrating another embodiment of a movement-capable game board built in accordance with the present invention.

FIG. 2I is a perspective diagram illustrating another embodiment of a movement-capable game board 200I built in accordance with the present invention. The movement-capable game board 200I is a two-dimensional game board having an indefinite dimension m,n. A selected portion of the game board 200I is shown having two 2×2 sub-sets: one sub-set of spaces, tiles, or blocks of 1,3; 1,4; 2,3; and 2,4 and one sub-set of spaces, tiles, or blocks of 3,2; 3,3; 4,2; and 4,3. The two sub-sets are swapped and rotated as shown by the arrow in the FIG. 2I. Similarly, as mentioned above, the action that initiates the swapping and rotation movement is any number of operations including initiation by any of the players of the game, by one of the players occupying a wildcard tile or block of the movement-capable game board 200I. In addition, a single space, tile, or block of m,2 is rotated clockwise (cw) 90 degrees. The walls of m,2 are shifted so that the walls are adjacent to other portions.

FIG. 2J is a perspective diagram illustrating the movement-capable game board 200J of the FIG. 2I after the movement operation shown in the FIG. 2I. After performing the swapping and rotating movement in the FIG. 2I, the sub-set of spaces, tiles, or blocks of 1,3; 1,4; 2,3; and 2,4 and the sub-set of spaces, tiles, or blocks of 3,2; 3,3; 4,2; and 4,3 of the FIG. 2I are moved, so that the same cross section, when viewed from left to right and top to bottom, is now shown as having the swapped sub-sets of the sub-set of spaces, tiles, or blocks of 4,2; 4,3; 3,2; and 3,3 and the sub-set of spaces, tiles, or blocks of 2,3; 2,4; 1,3; and 1,4. The rotating shown above may be viewed as being a flipping along an axis that is parallel to the layout of the movement-capable game board 200I; for example, the rotation may be viewed as being along an axis that is aligned along the paper on which the movement-capable game board 200I is being illustrated. If desired, as shown in some of the other embodiments, any rotation may be along an axis that may be viewed as extending out of the paper on which a game play space is being illustrated as well. Moreover, the single space, tile, or block of m,2 that is rotated clockwise (cw) 90 degrees is shown as having its respective walls rotated so that the walls are adjacent to other portions of other adjacent spaces, tiles, or blocks.

Figures 3A, 3B:
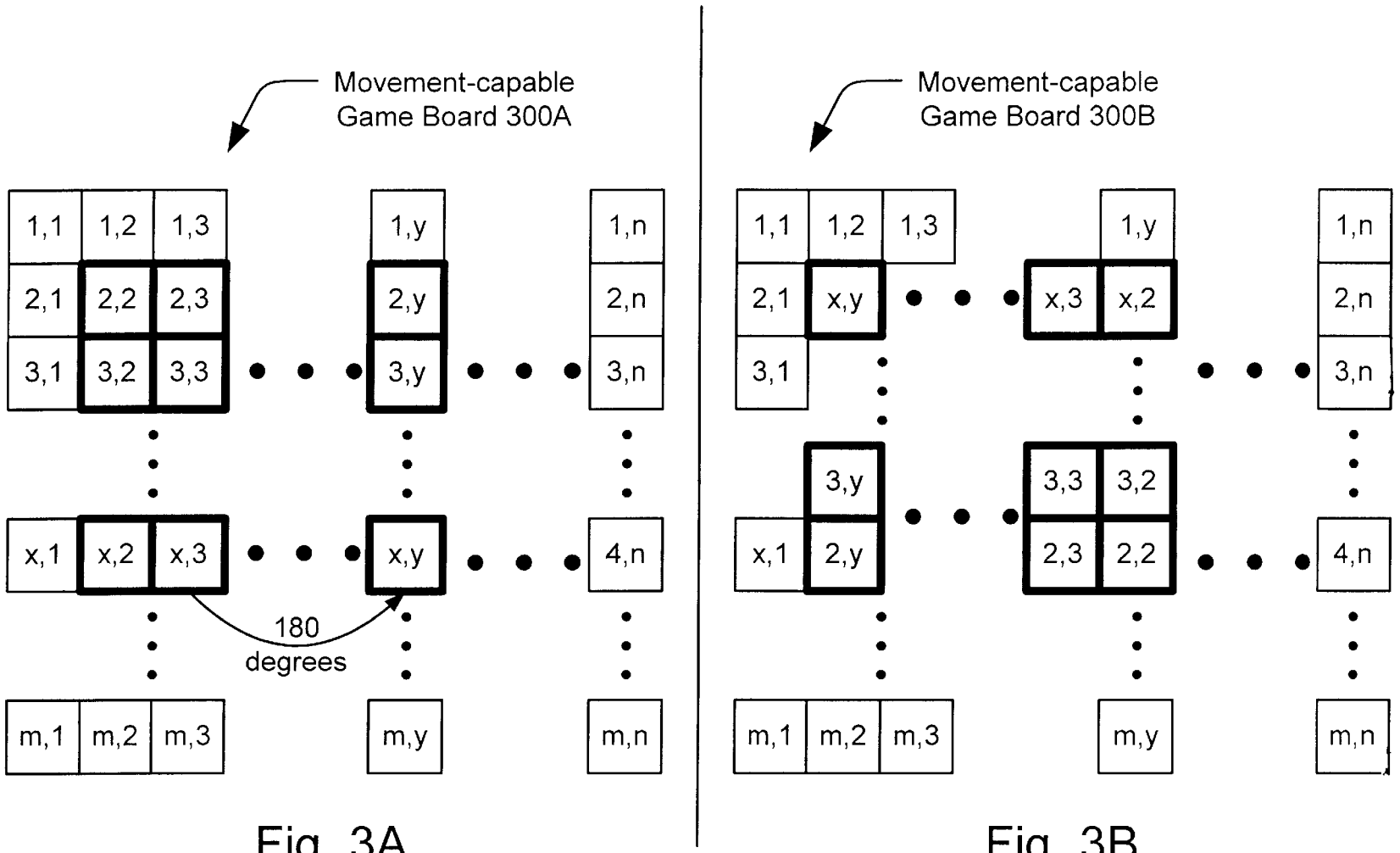
FIG. 3A is a perspective diagram illustrating another embodiment of a movement-capable game board built in accordance with the present invention.
FIG. 3B is a perspective diagram illustrating the movement-capable game board of the FIG. 3A after the movement operation shown in the FIG. 3A.

FIG. 3A is a perspective diagram illustrating another embodiment of a movement-capable game board 300A built in accordance with the present invention. The movement-capable game board 300A is a two-dimensional game board having an indefinite dimension m,n. An indefinitely sized portion of the game board 300A is shown having the spaces, tiles, or blocks of 2,2; 2,3; . . . ; 2,y; 3,2; 3,3; . . . ; 3,y; . . . ; x,2; x,3; . . . ; and x,y. The outer spaces, tiles, or blocks of the selected 3×3 portion are rotated clockwise (cw) 180 degrees as shown by the arrow in the FIG. 3A. Again, as mentioned above, the action that initiates the rotation movement is any number of operations including initiation by any of the players of the game, by one of the players occupying a wildcard tile or block of the movement-capable game board 300A.

FIG. 3B is a perspective diagram illustrating the movement-capable game board of the FIG. 3A after the movement operation shown in the FIG. 3A. After performing the 180 degree rotation in the FIG. 3A, the spaces, tiles, or blocks of 2,2; 2,3; . . . ; 2,y; 3,2; 3,3; . . . ; 3,y; . . . ; x,2; x,3; . . . ; and x,y of the FIG. 1A are moved, so that the same cross section, when viewed from left to right and top to bottom, is now shown as being the spaces, tiles, or blocks of x,y; . . . ; x,3; x,2; . . . ; 3,y; . . . ; 3,3; 3,2; 2,y; . . . ; 2,3; and 2,2.

Clearly, the FIGS. 1A–3B are illustrative of the movements of portions of the game boards that can be performed in accordance with the present invention. Other movements, including any number of degree rotations can also be performed. Any other movements can also be performed. Any sized portion, including non-square or non-rectangular portions, is also capable to be selected. The portions shown above are representative of one particular type of portions that can be selected while practicing the present invention. Moreover, the movements capable within those selected portions are any combination of movement where there is movement of at least two spaces, tiles, or blocks within the entire game play space.

Figure 4B:
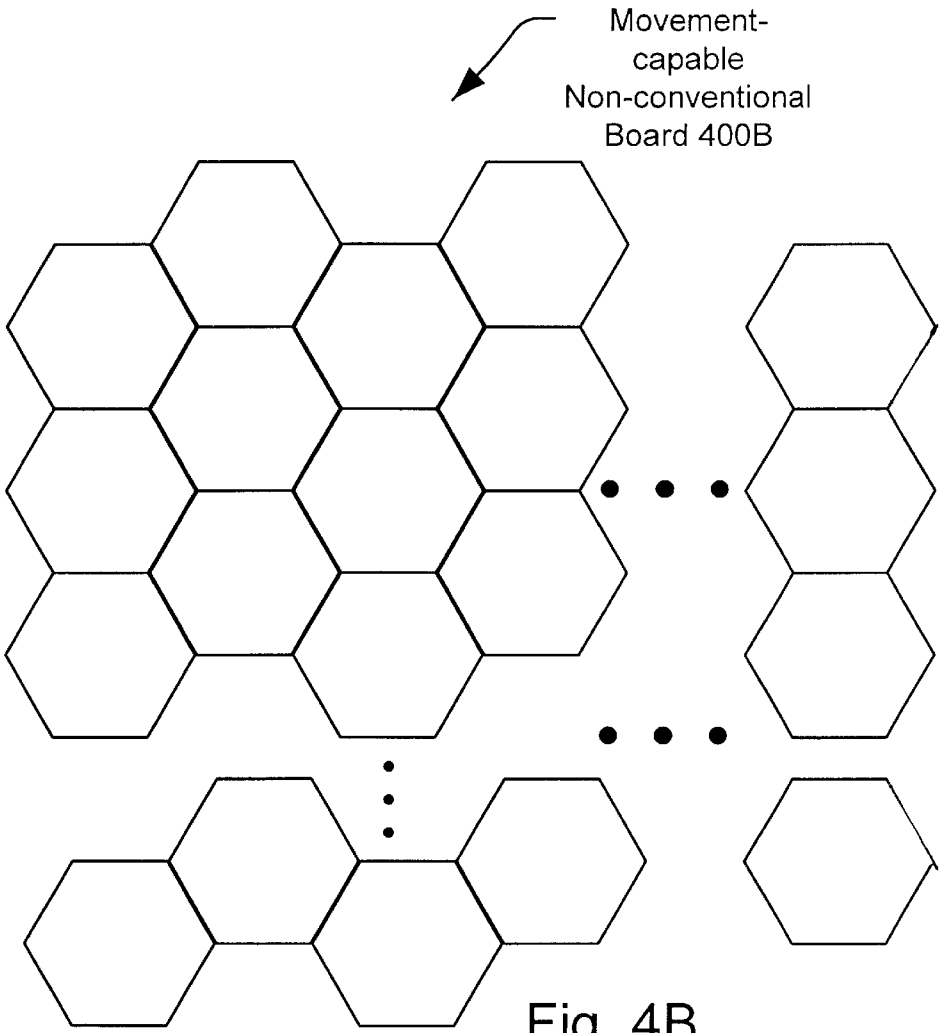
FIG. 4B is a perspective diagram illustrating an embodiment of a movement-capable non-conventional game board built in accordance with the present invention.
Figure 4A:
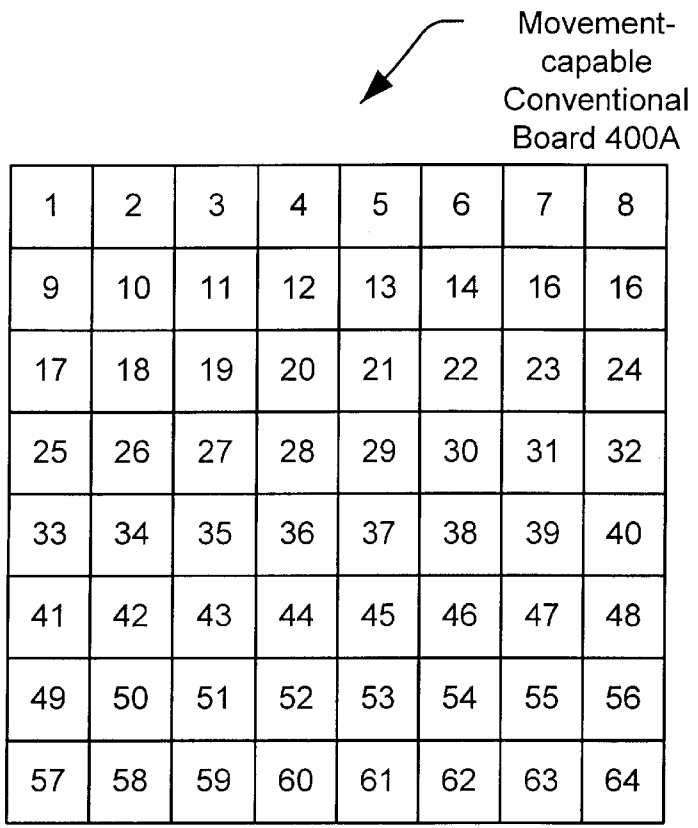
FIG. 4A is a perspective diagram illustrating an embodiment of a movement-capable conventional game board built in accordance with the present invention.

FIG. 4A is a perspective diagram illustrating an embodiment of a movement-capable conventional game board 400A built in accordance with the present invention. The movement-capable conventional game board 400A is viewed as being a game board having uniform blocks arranged in an 8×8 block configuration. The movement-capable conventional game board 400A is a standard 8×8 checker or chess board. Any other number of games capable of being played on the standard 8×8 checker or chess board are also operable in accordance with the present invention. If desired, the initiation of the movement of a selected portion of the play space is made only by a particular type of game piece. For example, in a checkers implementation, perhaps only a king type of game piece is able to initiate any modification of the game play space. In a chess implementation, perhaps only a bishop, a knight, or a rook type of game piece is able to initiate any modification of the game play space. Alternatively, the present invention is operable such that different types of game pieces each have an ability to perform modification of the game play space in different ways. Other selections of the available types of game pieces is also able to be performed.

FIG. 4B is a perspective diagram illustrating an embodiment of a movement-capable non-conventional game board 400B built in accordance with the present invention. The movement-capable non-conventional game board 400B is exemplary of a two-dimensional (2D) board, having tiles of hexagonal shape. The movement-capable non-conventional game board 400B is indefinitely scaleable. As described above in variations of game play spaces above having substantially square spaces, tiles, or blocks, irrespective of the sizes of the game play spaces, any number of modifications or any number of portions of the movement-capable non-conventional game board 400B is able to be performed while practicing the present invention.

Figure 5B:
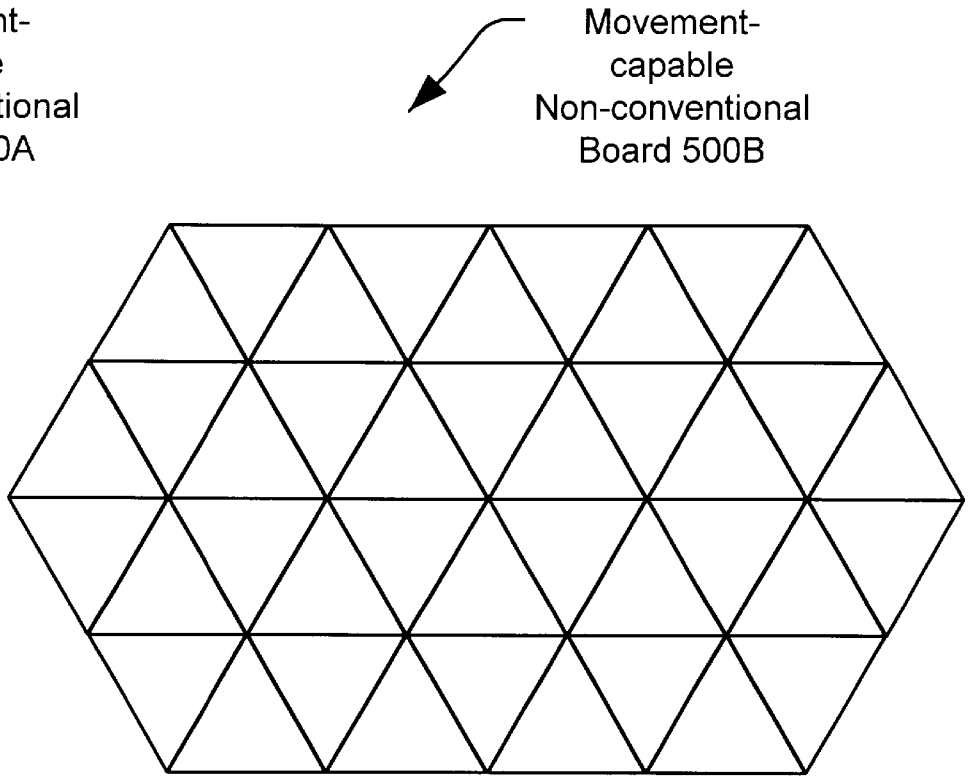
FIG. 5B is a perspective diagram illustrating another embodiment of a movement-capable non-conventional game board built in accordance with the present invention.
Figure 5A:
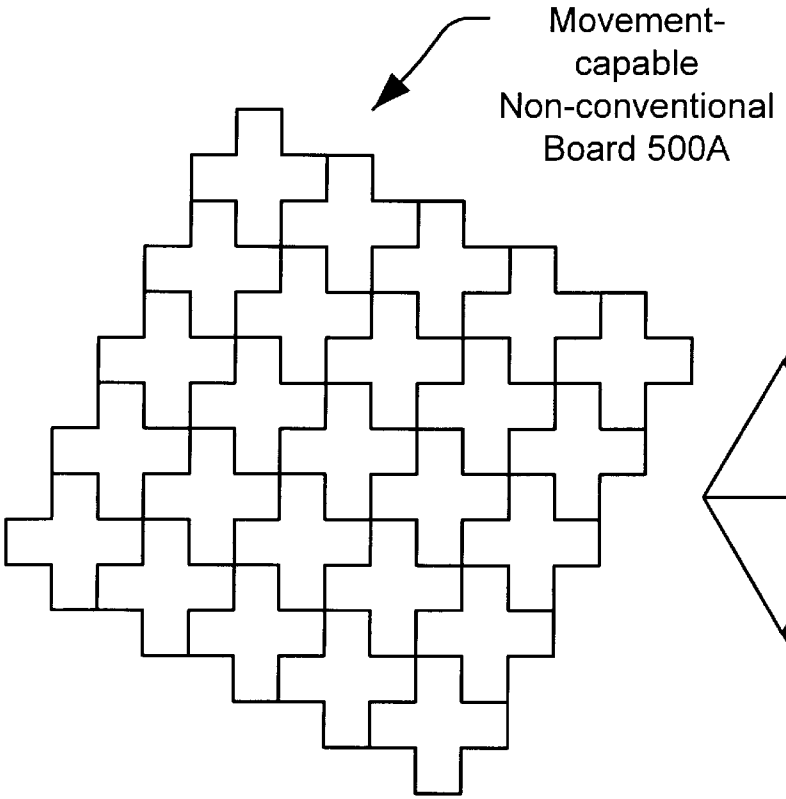
FIG. 5A is a perspective diagram illustrating another embodiment of a movement-capable non-conventional game board built in accordance with the present invention.

FIG. 5A is a perspective diagram illustrating another embodiment of a movement-capable non-conventional game board built in accordance with the present invention. The movement-capable non-conventional game board 500A is exemplary of a two-dimensional (2D) board, having tiles of cross-like shape. The movement-capable non-conventional game board 500A is indefinitely scaleable. As described above in variations of game play spaces above having substantially square spaces, tiles, or blocks, irrespective of the sizes of the game play spaces, any number of modifications or any number of portions of the movement-capable non-conventional game board 500A is able to be performed while practicing the present invention.

FIG. 5B is a perspective diagram illustrating another embodiment of a movement-capable non-conventional game board built in accordance with the present invention. The movement-capable non-conventional game board 500B is exemplary of a two-dimensional (2D) board, having tiles of triagonal shape. The movement-capable non-conventional game board 500B is indefinitely scaleable. As described above in variations of game play spaces above having substantially square spaces, tiles, or blocks, irrespective of the sizes of the game play spaces, any number of modifications or any number of portions of the movement-capable non-conventional game board 500B is able to be performed while practicing the present invention.

Figure 6B:
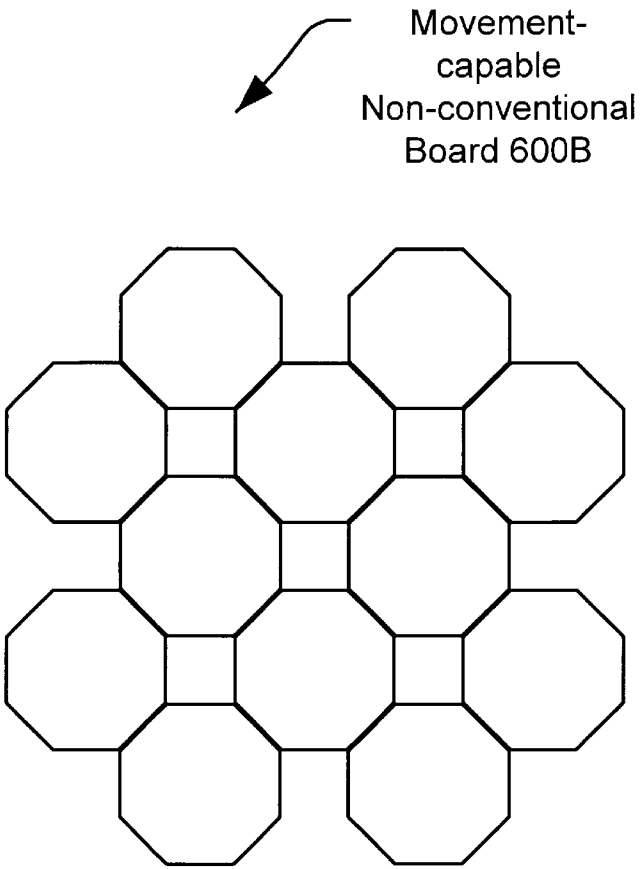
FIG. 6B is a perspective diagram illustrating another embodiment of a movement-capable non-conventional game board built in accordance with the present invention.
Figure 6A:
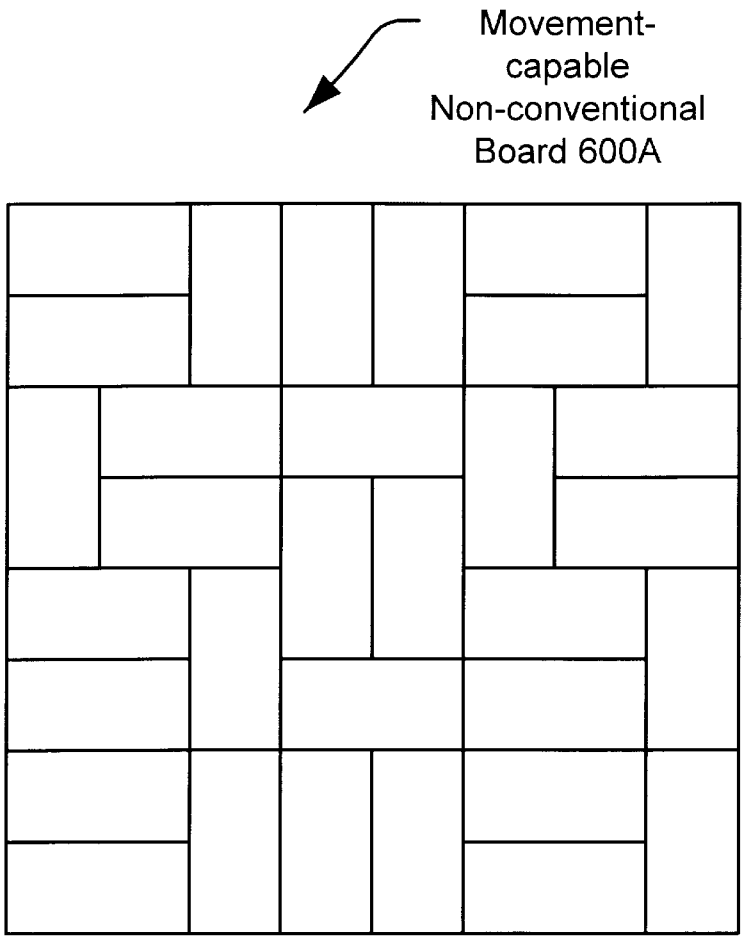
FIG. 6A is a perspective diagram illustrating another embodiment of a movement-capable non-conventional game board built in accordance with the present invention.

FIG. 6A is a perspective diagram illustrating another embodiment of a movement-capable non-conventional game board built in accordance with the present invention. The movement-capable non-conventional game board 600A is exemplary of a two-dimensional (2D) board, having tiles of rectangular shape. The movement-capable non-conventional game board 600A is indefinitely scaleable. As described above in variations of game play spaces above having substantially square spaces, tiles, or blocks, irrespective of the sizes of the game play spaces, any number of modifications or any number of portions of the movement-capable non-conventional game board 600A is able to be performed while practicing the present invention.

FIG. 6B is a perspective diagram illustrating another embodiment of a movement-capable non-conventional game board built in accordance with the present invention. The movement-capable non-conventional game board 600B is exemplary of a two-dimensional (2D) board, having tiles of both octagonal and square shapes that are inter-mingled. More generally, the movement-capable non-conventional game board 600B is exemplary of a two-dimensional (2D) board, having tiles, spaces, or blocks of at least two types of shapes that are inter-mingled. The movement-capable non-conventional game board 600B is indefinitely scaleable. As described above in variations of game play spaces above having substantially square spaces, tiles, or blocks, irrespective of the sizes of the game play spaces, any number of modifications or any number of portions of the movement-capable non-conventional game board 600B is able to be performed while practicing the present invention.

Figure 7:
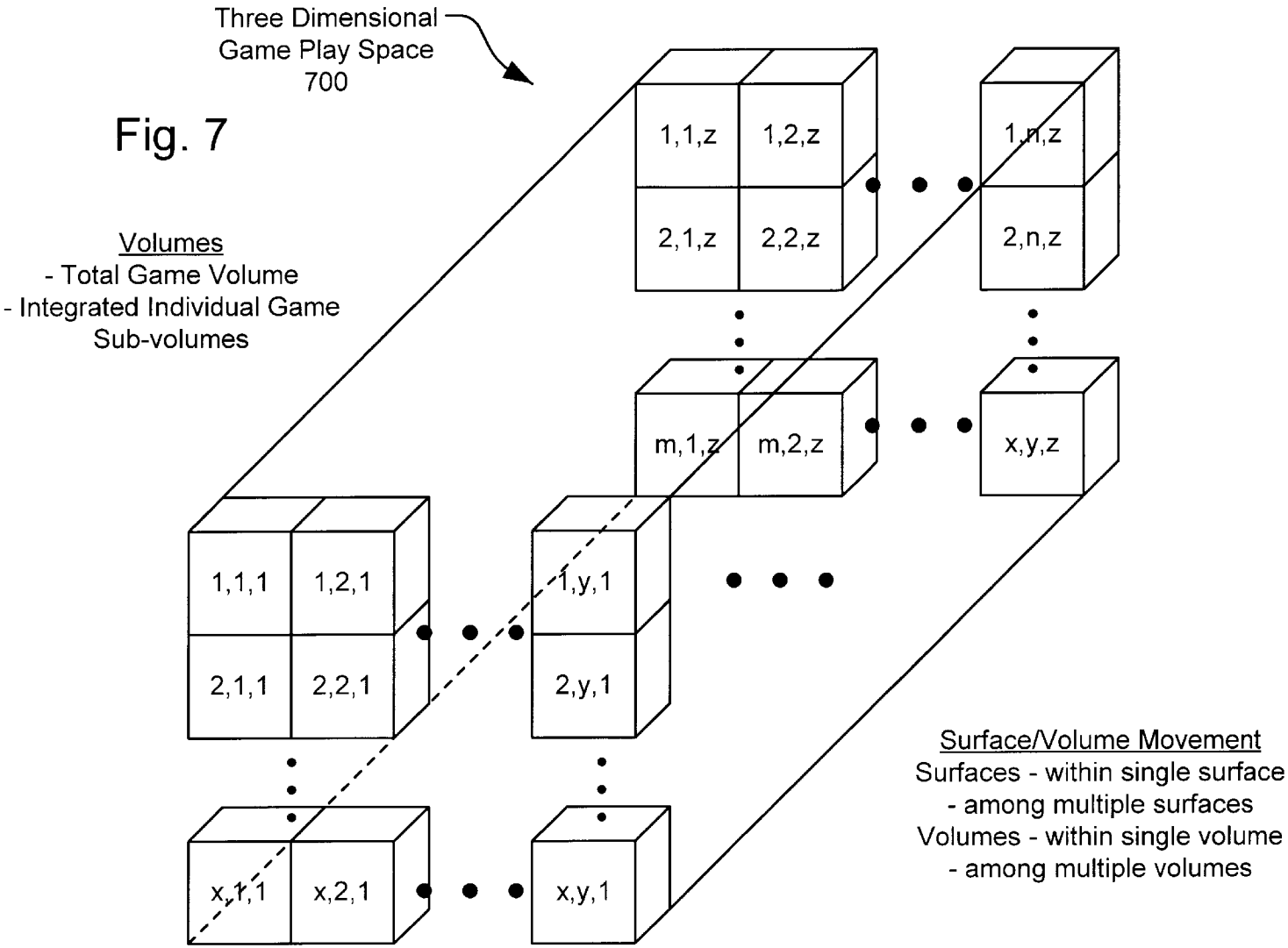
FIG. 7 is a perspective diagram illustrating an embodiment of a three-dimensional game play space that is built in accordance with the present invention.

FIG. 7 is a perspective diagram illustrating an embodiment of a three-dimensional game play space 700 that is built in accordance with the present invention. The three-dimensional game play space 700 is a movement-capable, three-dimensional game board having an indefinite dimension x,y,z. Each of the individual volumetric blocks within the three-dimensional game play space 700 is an individual tile or block within a single game in some embodiments of the present invention. Alternatively, each volumetric blocks within the three-dimensional game play space 700 is an individual tile or block representing an additional, individual game that is coupled to the other volumetric blocks. For example, the spaces, tiles, or blocks along and within each of the individual volumetric blocks of the three-dimensional game play space 700 are able to be modified in accordance with the present invention. Moreover, the various volumetric blocks themselves are able to be interchanged with one another as well. For example, the volume shown as 1,1,1 is able to be interchanged with any other of the volumetric blocks within the three-dimensional game play space 700. Movement or modification of the game play space is able to be performed within a single surface of a volumetric block or among multiple surfaces within a single volumetric block or among multiple volumetric blocks.

Figure 8:
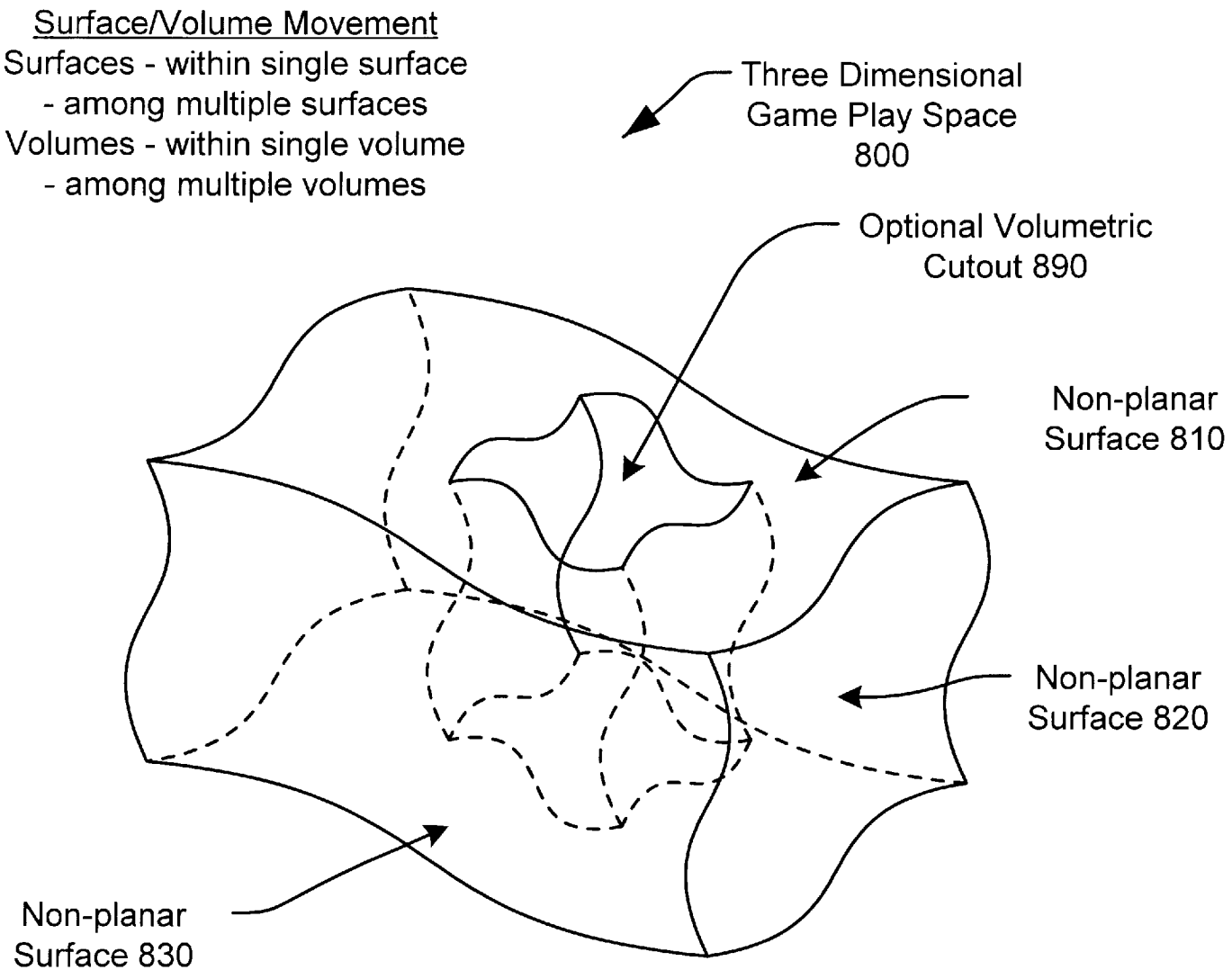
FIG. 8 is a perspective diagram illustrating another embodiment of a three-dimensional game play space that is built in accordance with the present invention.

FIG. 8 is a perspective diagram illustrating another embodiment of a three-dimensional game play space 800 that is built in accordance with the present invention. The three-dimensional game play space 800 is exemplary of an embodiment of the invention having multiple surfaces. Various types of surfaces are used in the three-dimensional game play space 800. A non-planar surface 810, a non-planar surface 820, and a non-planar surface 830 are all part of the three-dimensional game play space 800. Multiple other sides complete this particular implementation of the three-dimensional game play space 800 to enclose a volume. Some of the sides of a three-dimensional game play space are planar in certain embodiments of the invention. If desired, both interior and exterior sides of the various surfaces of the three-dimensional game play space 800 are used to employ grids having tiles that are used for various player interaction in accordance with the present invention.

In addition, an optional volumetric cutout 890 is cut out of the center of the three-dimensional game play space 800. Such a cutout not only further limits the various surfaces of the three-dimensional game play space 800, but it also generates additional surfaces on which various players interact.

Moreover, the playing of a game, in accordance with the present invention, is performed not only among the various surfaces of the three-dimensional game play space 800, but also within the interior volume of the three-dimensional game play space 800. For example, a three-dimensional game volume is employed instead of solely the two-dimensional surfaces of the three-dimensional game play space 800.

Figure 9:
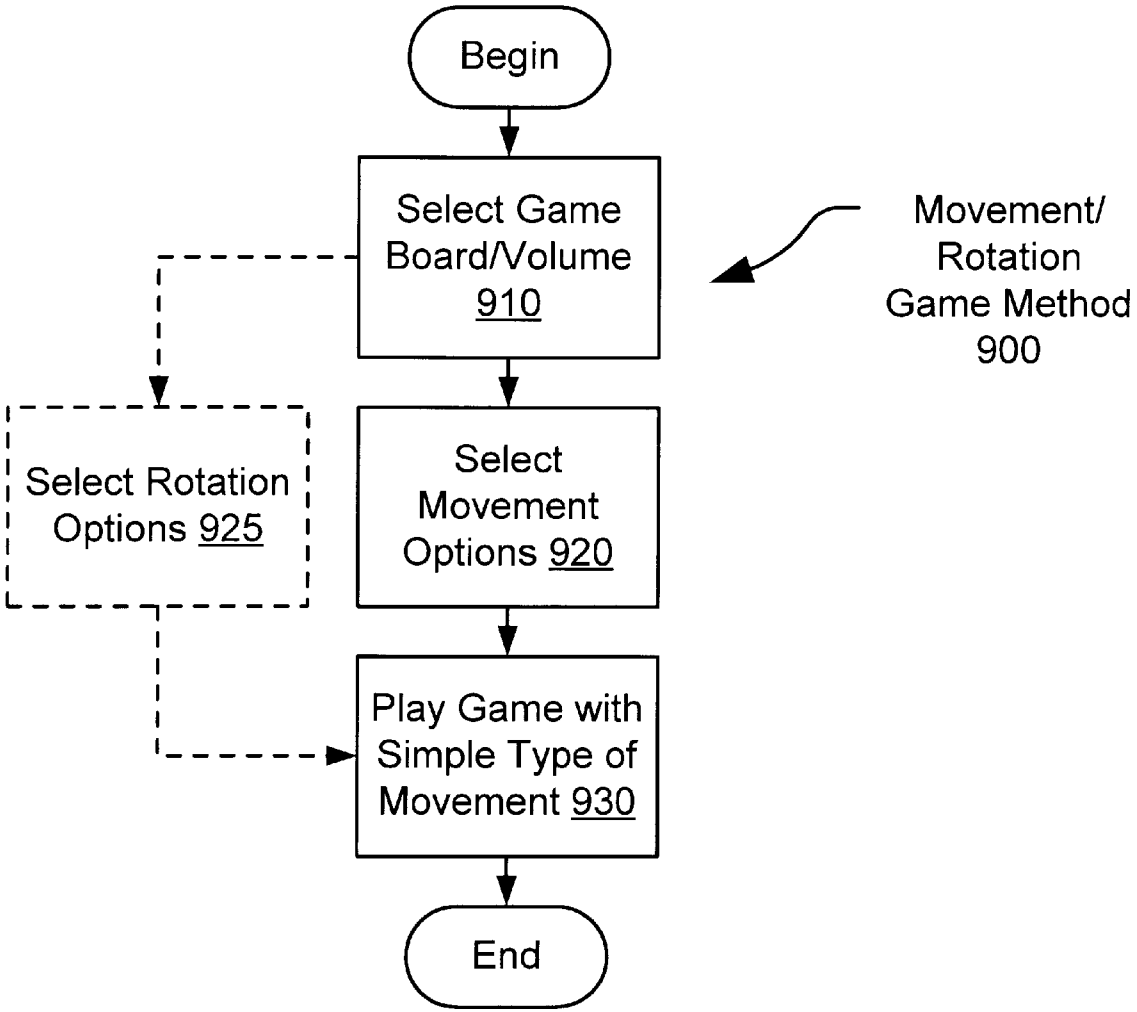
FIG. 9 is a functional block diagram illustrating an embodiment of a movement/rotation game method performed in accordance with the present invention.

FIG. 9 is a functional block diagram illustrating an embodiment of a movement/rotation game method 900 performed in accordance with the present invention. In a block 910, a game board portion or volume portion is selected. Then, in a block 920, movement options are selected for the portion selected in the block 910. If desired in an alternative embodiment, rotation options are selected for the portion selected in the block 925. In some embodiments of the inventions, both of the blocks 920 and 925 are performed in the movement/rotation game method 900. Finally, playing of the game is performed in a block 930 using simple types of movements after the selection of the movement and/or rotation is performed in the block 920 or in the blocks 920 and 925.

Figure 10:
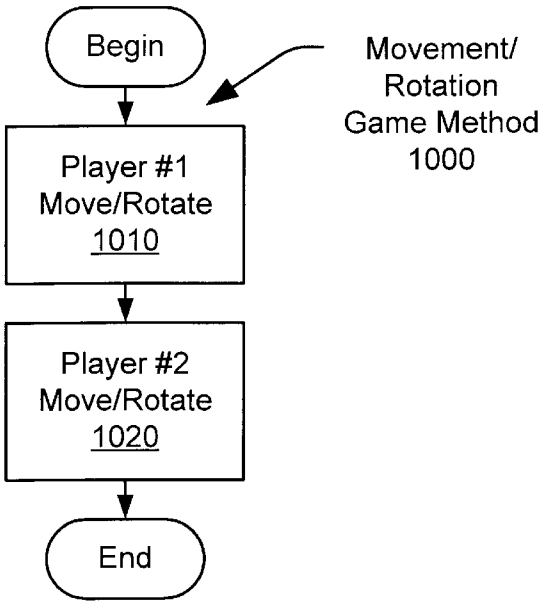
FIG. 10 is a functional block diagram illustrating another embodiment of a movement/rotation game method performed in accordance with the present invention.

FIG. 10 is a functional block diagram illustrating another embodiment of a movement/rotation game method 1000 performed in accordance with the present invention. In a block 1010, a player #1 performs a move and/or rotate operation. Subsequently, in a block 1020, a player #2 performs a move and/or rotate operation. The FIG. 10 is illustrative of an embodiment of the present invention where only two players play the game, and each player is proffered a single move and/or rotate operation. If desired, the single use of the move and/or rotate operation is viewed as being a power move available to each of the users once during a given round or game.

Figure 11:
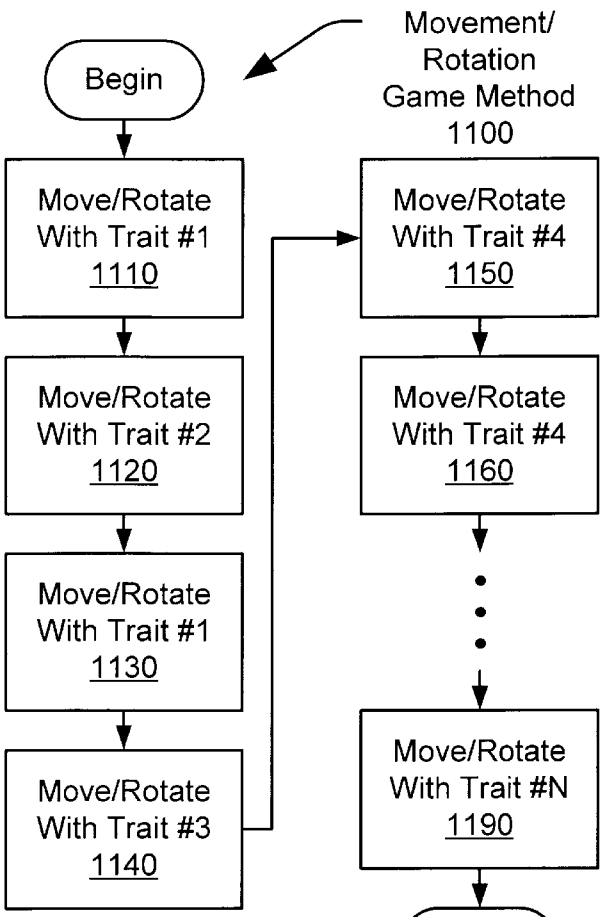
FIG. 11 is a functional block diagram illustrating another embodiment of a movement/rotation game method performed in accordance with the present invention.

FIG. 11 is a functional block diagram illustrating another embodiment of a movement/rotation game method 1100 performed in accordance with the present invention. In a block 1110, a move and/or rotate operation is performed using a trait #1. Then, in a block 1120, a move and/or rotate operation is performed using a trait #2. Then, in a block 1130, a move and/or rotate operation is performed again using the trait #1. Then, in a block 1140, a move and/or rotate operation is performed using a trait #3. Then, in a block 1150, a move and/or rotate operation is performed using a trait #4. Then again in a block 1160, a move and/or rotate operation is performed using the trait #4. After an indefinite number of move and/or rotate operations have been performed, in a block 1190, a move and/or rotate operation is performed with a trait #N. The FIG. 11 is illustrative of an embodiment of the present invention where single or multiple players play the game, and the single or multiple players are proffered any number of move and/or rotate operations, some of the move and/or rotate operations are of various types.

Figures 12, 13:
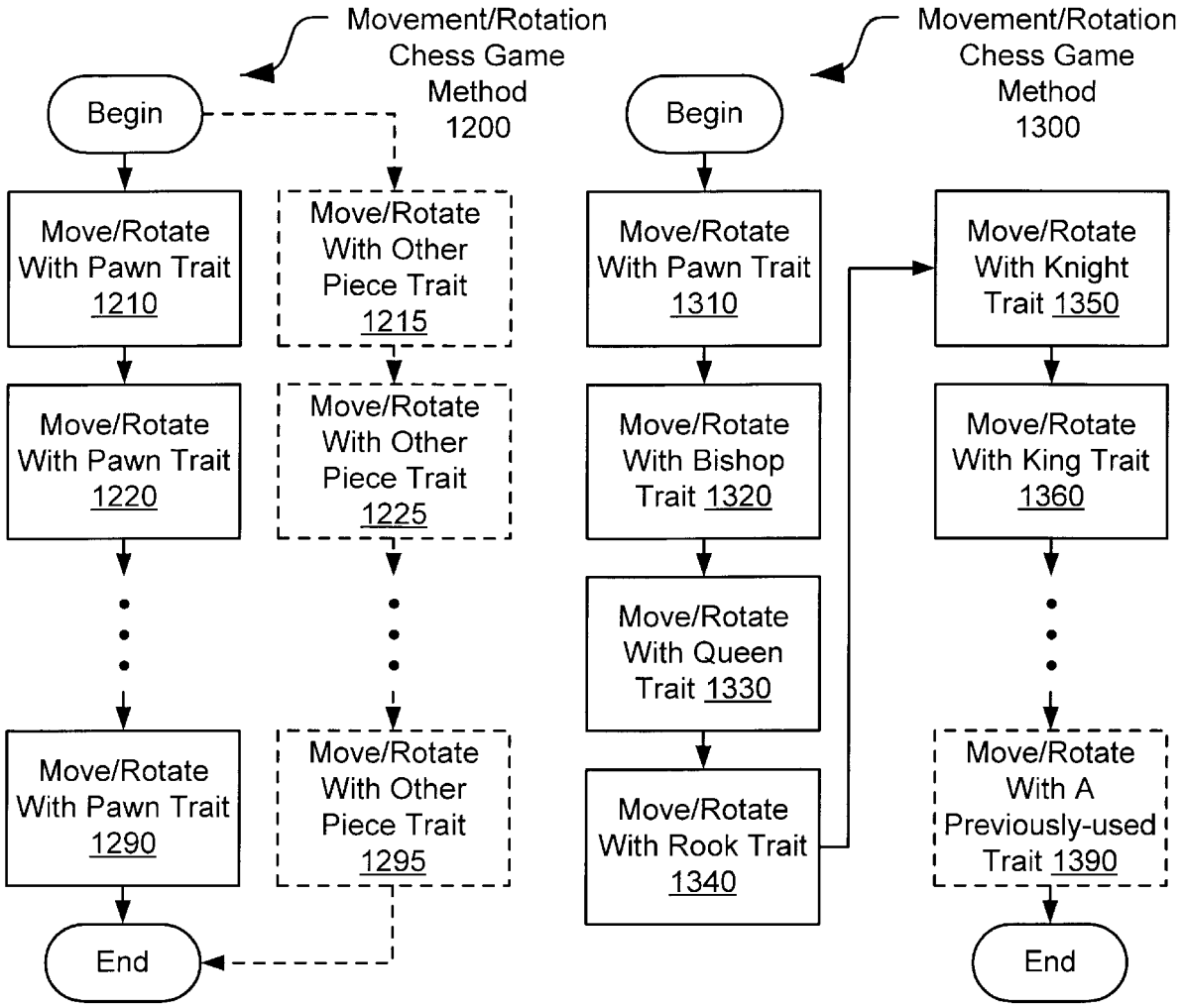
FIG. 12 is a functional block diagram illustrating another embodiment of a movement/rotation chess game method performed in accordance with the present invention.
FIG. 13 is a functional block diagram illustrating another embodiment of a movement/rotation chess game method performed in accordance with the present invention.

FIG. 12 is a functional block diagram illustrating another embodiment of a movement/rotation chess game method 1200 performed in accordance with the present invention. The movement/rotation chess game method 1200 is operable within the context of a chess game. In a block 1210, a player moves and/or rotates with a pawn trait. Subsequently, in a block 1220, a player also moves and/or rotates with the pawn trait. The movement and/or rotation in the blocks 1210 and 1220 are performed by the same player in some embodiments of the inventions; alternatively, the same player again performs the movement and/or rotation using the pawn trait. After an indefinite number of movements and/or rotations, in a block 1290, a player also moves and/or rotates with the pawn trait. Similarly as stated above, the movement and/or rotation in the block 1290 is performed by the same player in some embodiments of the inventions; alternatively, the same player again performs the movement and/or rotation using the pawn trait.

In other embodiments, the movement/rotation chess game method 1200 employs various movement and/or rotation traits for each of the various pieces of the chess game. For example, each of the various pieces is capable to have different game play space modification abilities. For example, in one such an embodiment, in a block 1215, a player also moves and/or rotates with any of the particular piece's traits. Subsequently, in a block 1225, a player also moves and/or rotates with any of the particular piece's traits. The movement and/or rotation in the blocks 1215 and 1225 are performed by the same player in some embodiments of the inventions; alternatively, the same player again performs the movement and/or rotation using the various pieces' traits. After an indefinite number of movements and/or rotations, in a block 1295, a player also moves and/or rotates with any of the particular piece's traits. Similarly as stated above, the movement and/or rotation in the block 1295 is performed by the same player in some embodiments of the inventions; alternatively, the same player again performs the movement and/or rotation using any of the particular piece's traits.

FIG. 13 is a functional block diagram illustrating another embodiment of a movement/rotation chess game method 1300 performed in accordance with the present invention. In a block 1310, a player moves and/or rotates with a pawn trait. Subsequently, in a block 1320, a player moves and/or rotates with a bishop trait. Subsequently, in a block 1330, a player moves and/or rotates with a queen trait. Subsequently, in a block 1340, a player moves and/or rotates with a rook trait. Subsequently, in a block 1350, a player moves and/or rotates with a knight trait. Subsequently, in a block 1360, a player moves and/or rotates with a king trait. After an indefinite number of movements and/or rotations, if desired in a block 1390, a player moves and/or rotates with any of the previously-used traits. The movement and/or rotation in all of the blocks within the movement/rotation chess game method 1300 are performed by the same player in some embodiments of the inventions; alternatively, the same player again performs the movement and/or rotation using the various piece's traits.

A GridBloc game is operable to be performed using the present invention. In one embodiment of the GridBloc game, there are various types of runners including that of a mouse ($R_{mouse}$), a bee ($R_{bee}$), a kangaroo ($R_{kangaroo}$), a cheetah ($R_{cheetah}$), and a doodlebug or a basicbug ($R_{basicbug}$ or a $R_{doodlebug}$).

A runner $R_{mouse}$ has an ability to pass into a wall. The runner $R_{mouse}$ is able to create a "mousehole" into an edging wall and move through contiguous walls exiting into any other directly edged tile. The runner $R_{mouse}$ is unable to enter or exit through the "end" of a wall. If desired, the number of times such a special trait may be used is limited to a predetermined number of times within a given game.

A runner $R_{bee}$ has an ability to jump a wall. The runner $R_{bee}$ is able to move from any tile to any other tile regardless of the wall configuration. One example of the movement of the runner $R_{bee}$ is when the runner is completely enclosed by walls. The runner $R_{bee}$ then invokes its special power and "flies" free to any other tile. If desired, the number of times such a special trait may be used is limited to a predetermined number of times within a given game.

A runner $R_{kangaroo}$ has an ability to break down a wall. The runner $R_{kangaroo}$ has an ability to knock down a wall, either temporarily or permanently, and then proceed to a next tile where it performs a regular move. Again, the number of times this special trait may be used is limited in certain embodiments of the invention. If desired, the number of times such a special trait may be used is limited to a predetermined number of times within a given game.

A runner $R_{cheetah}$ has an ability to move very quickly. The runner $R_{cheetah}$ moves several spaces in a single movement in certain embodiments of the invention. If desired, the total number of tiles across which the runner $R_{cheetah}$ is allowed to move is controlled or fixed to a predetermined number of tiles. It is variable in other embodiments, such as a function of the total number of accumulated points that the runner $R_{cheetah}$ currently has. If desired, the number of times such a special trait may be used is limited to a predetermined number of times within a given game.

A runner $R_{basicbug}$ or a $R_{doodlebug}$ has an ability to move at the most basic level offered in accordance with the present invention. For example, in one embodiment in a GridBloc board having square shaped tiles, the runner $R_{basicbug}$ or a $R_{doodlebug}$ is able only to move one block at a time in a given turn.

Figures 14, 15:
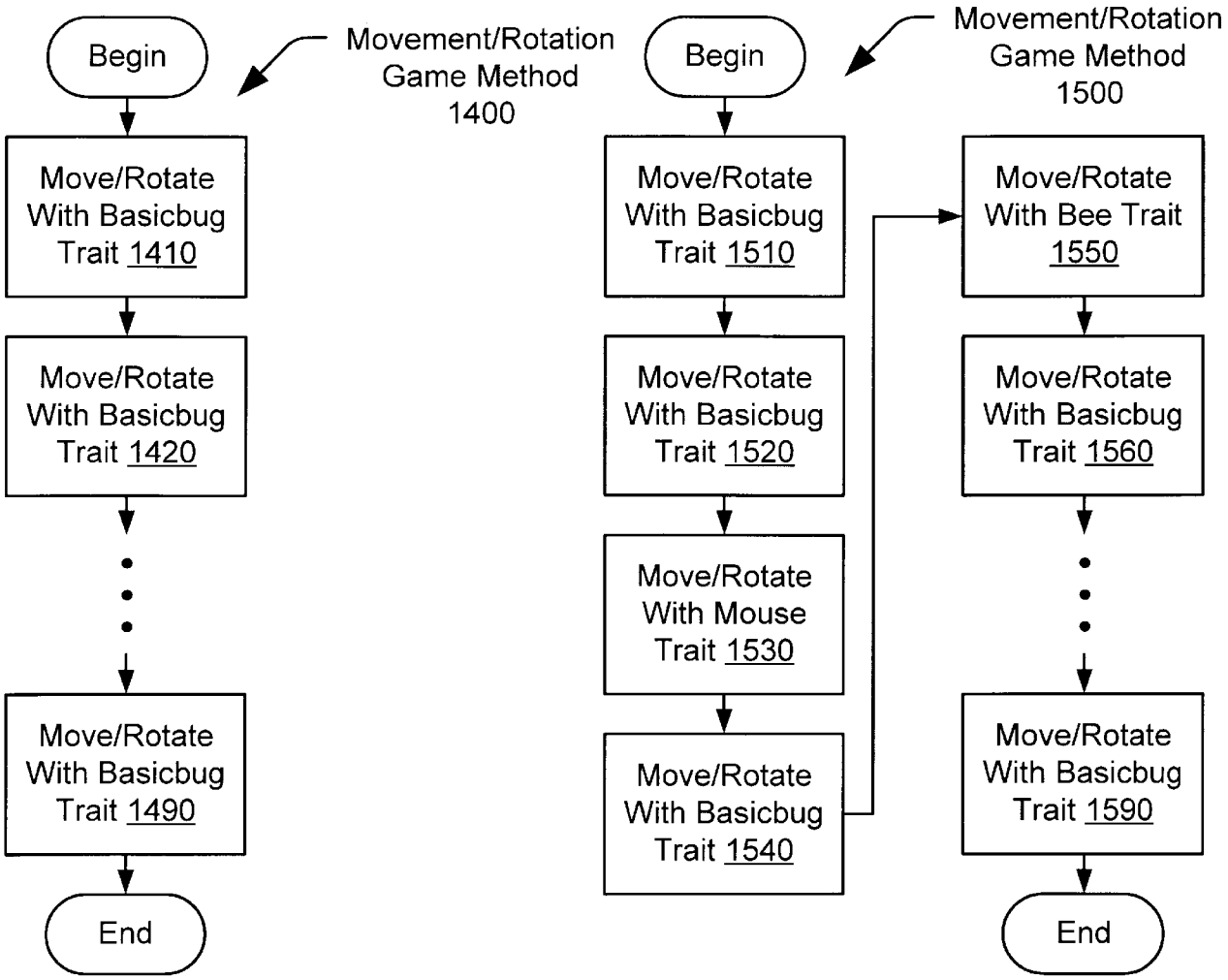
FIG. 14 is a functional block diagram illustrating another embodiment of a movement/rotation game method performed in accordance with the present invention.
FIG. 15 is a functional block diagram illustrating another embodiment of a movement/rotation game method performed in accordance with the present invention.

FIG. 14 is a functional block diagram illustrating another embodiment of a movement/rotation game method 1400 performed in accordance with the present invention. In a block 1410, a player moves and/or rotates with a basicbug trait. Subsequently, in a block 1420, a player also moves and/or rotates with the basicbug trait. After an indefinite number of movements and/or rotations, if desired in a block 1490, a player also moves and/or rotates with the basicbug trait. The movement and/or rotation in all of the blocks within the movement/rotation game method 1400 are performed by the same player in some embodiments of the inventions; alternatively, the same player again performs the movement and/or rotation using the various piece's traits.

FIG. 15 is a functional block diagram illustrating another embodiment of a movement/rotation game method 1500 performed in accordance with the present invention. In a block 1510, a player moves and/or rotates with a basicbug trait. Subsequently, in a block 1520, a player also moves and/or rotates with the basicbug trait. Subsequently, in a block 1530, a player moves and/or rotates with a mouse trait. Subsequently, in a block 1540, a player moves and/or rotates with the basicbug trait. Subsequently, in a block 1550, a player moves and/or rotates with a bee trait. Subsequently, in a block 1560, a player moves and/or rotates with the basicbug trait. After an indefinite number of movements and/or rotations, if desired in a block 1590, a player moves and/or rotates with the basicbug trait. The movement and/or rotation in all of the blocks within the movement/rotation chess game method 1500 are performed by the same player in some embodiments of the inventions; alternatively, the same player again performs the movement and/or rotation using the various piece's traits.

A game performed in accordance with the present invention is employed using any number of techniques. For example, the present invention is operable to be performed simply using a paper and pen or pencil. A hand operated implementation of the present invention is performed in such a manner. More sophisticated implementations are also performed using technologically advanced platforms such as computers. In fact, any computer processor that is operable to be programmed with the functionality to modify at least a portion of the game play space may be used to perform the game played in accordance with the present invention.

Moreover, when desired, any of the various traits and options of a game that is performed in accordance with the present invention are predefined. For example, a default setting is used at certain times, thereby allowing a user to initiate a game very quickly without having to select each and every permutation possible. A user is able to store or save certain predefined settings for these default situations.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A game board having a portion of a game play space that is movement-capable, comprising:

a game play space comprising a plurality of spaces having a first arrangement;

and a selected portion of the game play space that is operable to be modified during the course of a game, thereby changing the first arrangement of the plurality of spaces within the game play space to a second arrangement;

wherein a modification is triggered by an underlying structure of the game play space.

2. The game of claim 1, wherein the portion of the game play space that is movement-capable comprises a game board having uniform blocks arranged in an 8×8 block configuration.

3. The game of claim 1, wherein the selected portion of the game play space comprises a plurality of spaces that are arranged contiguously; and the underlying structure that triggers a modification comprises at least one of a type of game piece used by the player, a type of the game, or a location of the player in the game play space.

4. The game of claim 1, wherein each of a plurality of players is able to modify the selected portion of the game play space from the first arrangement to the second arrangement at least once during the course of a game.

5. The game of claim 1, wherein the plurality of spaces comprises spaces of at least two types of shapes that are inter-mingled.

6. The game of claim 1, wherein the game play space comprises at least one of a two-dimensional game play space and a three-dimensional game play space.

7. The game of claim 1, wherein the selected portion of the game play space that is operable to be modified comprises spaces along a surface of a three-dimensional game play space.

8. The game of claim 1, wherein the selected portion of the game play space that is operable to be modified comprises at least two volumes within a three-dimensional game play space.

9. A game having a moveable play space, comprising:

a game play space comprising a plurality of spaces; and at least two of the plurality of spaces are capable to be interchanged during the course of a game;

wherein an interchange is triggered by an underlying structure of the game play space.

10. The game of claim 9, wherein the game comprises a GridBloc game.

11. The game of claim 9, wherein a selected portion of the game play space is rotated a predetermined number of degrees.

12. The game of claim 9, wherein the underlying structure that triggers the interchange comprises at least one of a type of game piece used by the player of the game, a type of the game, or a location of a player in the game play space.

13. The game of claim 9, wherein the game play space is a three-dimensional game play space.

14. The game of claim 9, wherein the game play space is a two-dimensional game play space.

15. The game of claim 9, wherein a selected portion of the game play space is at least one of column shifted and flip-flopped.

16. A method to modify a game play space of a game, the method comprising:

selecting a portion of a game play space; and modifying the selected portion of the game play space during the course of a game;

wherein a modification is triggered by an underlying structure of the game play space.

17. The method of claim 16, wherein the game comprises a GridBloc game.

18. The method of claim 16, wherein the underlying structure of the game play space that triggers a modification comprises one of a type of game piece used by the player of the game, a type of the game, or a location of the player in the game play space.

19. The method of claim 16, wherein the game play space is at least one of a two-dimensional game play space and a three-dimensional game play space.

20. The method of claim 16, wherein the selected portion of the game play space comprises at least two volumes within a three-dimensional game play space.

* * * * *